United States Patent [19]

Eigenmann

[11] 3,964,559

[45] June 22, 1976

[54] APPARATUS FOR APPLYING TAPE MARKING MATERIAL ON ROAD SURFACES

[76] Inventor: Ludwig Eigenmann, Vacallo, Ticino, Switzerland

[22] Filed: Nov. 20, 1974

[21] Appl. No.: 525,373

[30] Foreign Application Priority Data

Nov. 22, 1973 Italy ..... 31633/73

[52] U.S. Cl. ..... 180/1 AP; 156/523; 180/14 R; 280/463

[51] Int. Cl.[2] ..... B60D 3/00

[58] Field of Search ..... 180/1 AP, 1 AS, 14 R; 280/463; 404/12, 14; 156/523, 577; 206/411; 40/125 N; 296/28 A

[56] References Cited

UNITED STATES PATENTS

| | | | |
|---|---|---|---|
| 2,546,308 | 3/1951 | Kahler | 156/577 X |
| 2,878,034 | 3/1959 | Wald | 280/463 |
| 2,946,603 | 7/1960 | Wald | 280/463 |
| 3,007,838 | 11/1961 | Eigenmann | 156/577 X |
| 3,124,371 | 3/1964 | Weir | 280/463 |
| 3,235,436 | 2/1966 | Eigenmann | 156/523 |
| 3,350,256 | 10/1967 | Eckman | 156/523 X |

*Primary Examiner*—M. H. Wood, Jr.
*Assistant Examiner*—Terrance L. Siemens
*Attorney, Agent, or Firm*—Michael J. Striker

[57] ABSTRACT

There is described an apparatus for forming traffic regulating indicia on road surfaces by applying tape material on a predetermined marking line trace. The apparatus consists of the combination of a service motor-van provided with steering means and driven by a first operator, and of a tape material applicator subassembly connected to and serviced by said motor-van and provided with its own steering means designed to be acted upon by a second operator, and with sight and collimation means designed for being collimated with said trace by said second operator which compensates for differences between the actual path of said motor-van and the marking line to be exactly provided.

7 Claims, 7 Drawing Figures

G
Bm

A
Bs
V
Bs
18
M
Ga
L
10
12
16
L
14
B
S
D

V1
58
S

D1
60
Ga
B
54
50
56
Bm
C 52
54
D1
Bm
B
Ga
56
50
V1
S
58
C

Fig. 4
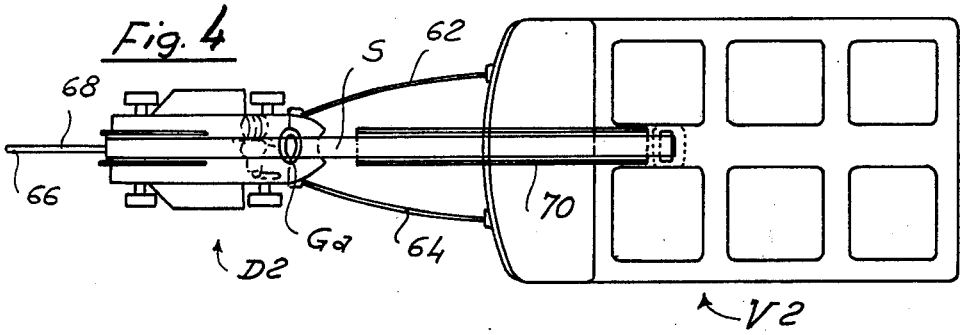
Fig. 5
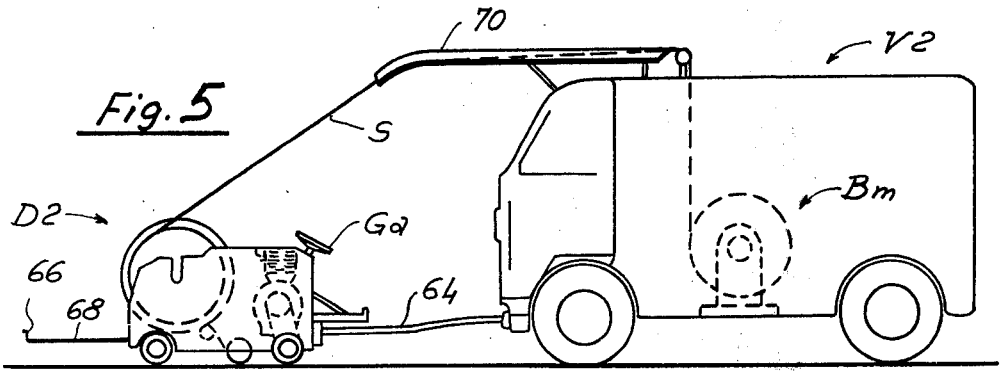
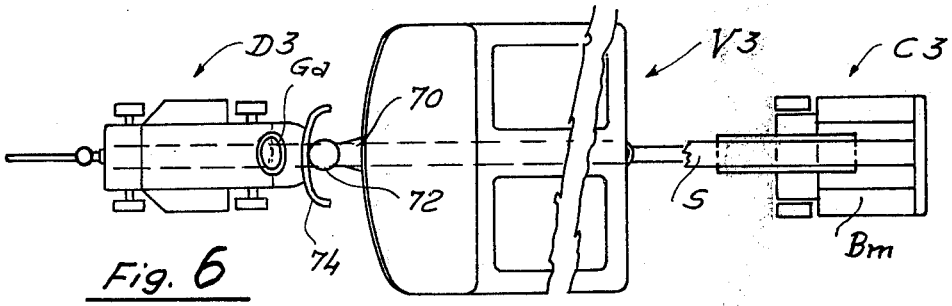
Fig. 6
Fig. 7
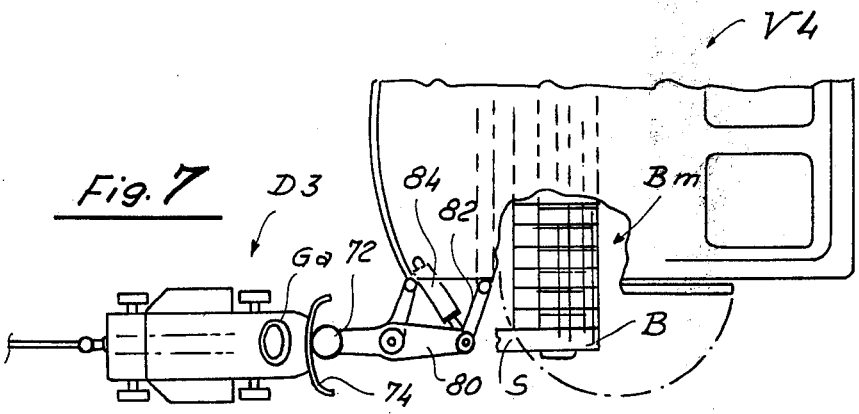

APPARATUS FOR APPLYING TAPE MARKING MATERIAL ON ROAD SURFACES

BACKGROUND OF THE INVENTION

1. The Field of the Invention

This invention relates to the art of marking of traffic dividing lines and other directional data upon the surface or pavement on streets and highways, by applying on and securing prefabricated road marking tape material to said pavement, and of providing a marked road thereby. More particularly, this invention is concerned with a new and advantageous apparatus or arrangement adapted to be driven over a road surface along a given path as defined by the marking line to be formed for laying down and pressing said tape material on said surface to form the marking line.

2. The Prior Art

This art is a well worked one and widely known. A variety of arrangements had been heretofore proposed therefor, such as the mechanisms and the machines described in the prior U.S. Pat. Nos. 3,007,838, 3,155,564 and 3,235,436, of same applicant. Such machines were subject to several limitations, more particularly concerning their cost, weight and scarce ability to be driven at a desirable speed along the necessary path. These and other considerations, together with the availability of more efficient tape materials and of procedures for forming a primer layer upon the road pavement for receiving and permanently securing the material, have promoted substantial improvements in this art.

A substantial improvement comprises providing an apparatus for applying traffic-regulating tape indicia to road surfaces, the apparatus consisting of the combination of a service unit including a motor-van (in the broadest meaning of the term) adapted to be driven over a road surface along a given path and containing means for transportation and supplying of tape material, of compounds and substances as well as sources of energy necessary for forming the indicia, and preferably also for preliminarily forming on the road surface a primer layer on which the tape material is then laid down, and of a tape material applicator subassembly including devices for laying down said tape material on said surface, preferably also for forming said primer layer on said surface and then laying down the tape material thereon, said subassembly being connected to and operatively associated with said service unit.

Arrangements, subassemblies and devices as above have been described in the published French Patent Nos. 72.27216, 73.14075 and 73.32566 of same applicant. (U.S. patent applications Ser. No. 275,427, filed July 26, 1972, Ser. No. 350,830, filed Apr. 13, 1973 and No. 397,245, filed Sept. 14, 1973). These arrangements have been satisfyingly produced and made use of. Said multiple units have however been subject to some serious objections; particularly they cannot provide the most desirable flexibility of service in the widest range of operation from forming at a substantial speed indicia along highways to provide intricate marking patterns at crossings, parking lanes and the like. A serious limitation consists in the fact that the regular laying down of the tape material (including the preformation of the primer layer, if any) on the precise path defined by the marking line to be formed, (said path being visualized, according to the art, by a trace consisting of a sequence of marks chalked on the road surface, by a string or a ribbon located thereon, or also by the remaining parts of a not completely obliterated preceedingly formed indicium, and so on), depends only upon the extreme attention and of the skill of the driver of the service unit who has also the responsibility of maintaining the proper operational speed and to act on the various controls of the motor-van.

It is therefore object of this invention to provide a new and advantageous apparatus and arrangement which are not subject to the above and other limitations and by which a most efficient operation can be performed in the most various occurrences to meet the widely variable marking requirements.

SUMMARY OF THE INVENTION

According to the invention, there is provided an apparatus for forming traffic regulating indicia on road surface by selectively applying tape material on a predetermined marking line trace, the apparatus consisting of the combination of a service unit forming motor-van and of a tape material applicator subassembly operatively associated with said service unit, wherein said motor-van is provided with steering means operatively by a first operator for driving said motor-van at a given speed along a path approximately concurrent with said marking line trace, wherein second steering means operatable by a second operator are connected with marking line trace aiming and collimating means and with the said tape material applicator subassembly for causing said subassembly to lay down tape material exactly on and along said trace when said aiming and collimating means are caused to exactly collimate with said marking line trace by operating said second steering means, and wherein said motor-van is connected to said subassembly by movement transmitting and material transferring means adapted to permit lateral displacement of said subassembly relatively to said motor-van of amplitude greater than a predetermined difference between the approximate path followed by the motor-van the precise path followed by the applicator subassembly with respect to the marking line.

The above principle of the invention can be applied and made use of in a variety of arrangements either one of which can be considered as preferred in view of specific requirements, procedures and local conditions in which marked roads are to be provided. The above and other objects, advantages and features of the invention will be now made apparent by the following detailed description of some exemplary but not limitative embodiments of this invention, the description being referred to the accompanying drawings.

BRIEF DESCRIPTION OF THE DRAWINGS

FIGS. 4 and 5 are diagrammatical plan a respectively side views of a third embodiment of the invention;

FIG. 6 is a fragmentary view from above of a preferred modification of the arrangement of FIGS. 4 and 5, including also some components of the embodiment of FIGS. 2 and 3; and FIG. 7 is a fragmentary diagrammatical view from above of a still other embodiment of the invention, wherein certain features of the embodiments of FIGS. 1 and 6 are combined.

DETAILED DESCRIPTION OF THE PREFERRED EMBODIMENTS

Figure 1:
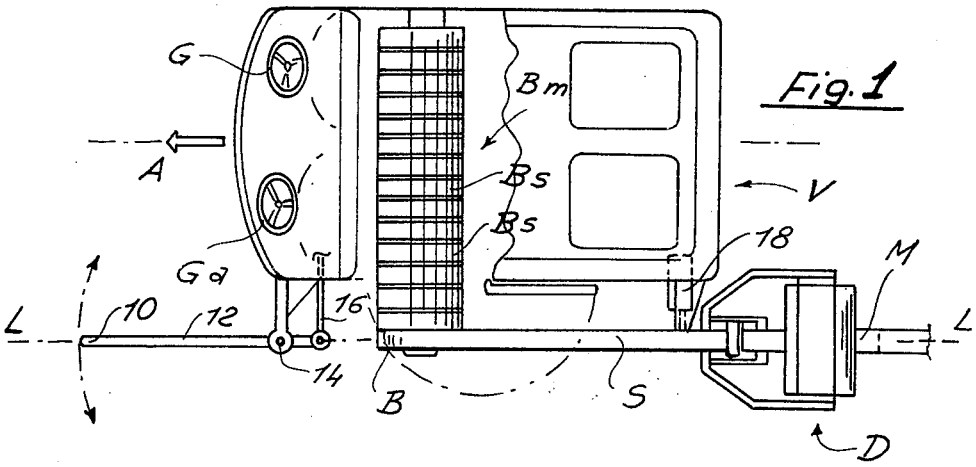
FIG. 1 is a diagrammatical view from above, with some part broken away, of a first embodiment of the invention.

In the several Figures of the drawings, the service units and the marking tape applicator subassemblies and the devices related therewith are diagrammatically and generally illustrated, and such units, subassemblies and devices will not be detailedly described since they do not constitite part of the invention, when individually considered. As a matter of fact, each one of such components, as individually considered, can be readily construed and manufactured by applying current knowledge of the art, either by taking advantage of the art of general automotive art and mechanics or by applying and adapting the teachings of the above indicated patent literature. Further for simplicity certain components and means which are critical for making and using the invention (such as flexible duct means, mechanical links, automotive steering and driving means and so on) are omitted in the drawings and will not be detailedly described as being most widely known and well within the most common knowledge of those skilled in the art to which this invention appertains.

Referring firstly to FIG. 1, there is shown an apparatus including a motor-van generally indicated at V provided with conventional motor and body means, and with steering means operable by a first operator who acts on a conventional steering wheel G for guiding the van V in a general direction A approximately parallel to and at an approximate lateral spacing from the trace of the marking line, generally indicated at L—L. The service unit formed by the motor-van V and by its various implements, including a tape material magazine Bm storing a plurality of spare bobbins Bs of such material, is connected to and operatively associated with a tape applicator device D adapted to form the desired marking indicium M on the road surface, by laying down and pressing thereon the tape S progressively unwound from a bobbin B. It is evident that the exact positioning of the tape S on the marking line L—L is essential for providing a proper marking indicium M, and that such exact positioning depends on the fact that the device D will follow a path exactly corresponding to said line L—L while being trailed or otherwise driven by the motor-van V.

The task of ensuring that said device D will exactly follow the marking line trace at L—L is performed by a second operator who acts on an auxiliary steering wheel Ga which, in this first embodiment of the invention, is on the same motor-van V. An operator controlled sight 10 is secured to the fore end of a collimator rod or stem 12 oscillatably secured at 14 for swinging movement about a vertical axis relatively to the motor-van V, said collimator stem 12 being mechanically or otherwise (such as hydraulically) connected to the auxiliary steering wheel Ga so that by turning clockwise or counterclockwise said steering wheel Ga the said sight 10 can be rightwardly or respectively leftwardly moved.

The said device D is at its turn connected to the motor-van by means designed to impart, at command, a lateral displacement to said device D relatively to the motor-van, the amplitude of said displacement being such to encompass any reasonable variation of the lateral spacing between the actual path A of the motor-van and the marking line L—L, variation resulting by the unavoidably approximate steering of the van on the part of the first operator. Such means can consist of a two-stroke fluid actuator such as generally indicated at 18.

By applying current knowledge in the art of fluid remote controls and actuators, such as of autocars hydraulic power steering mechanisms, the actuator 18 is follow-up linked to the auxiliary steering wheel Ga so that, when such auxiliary steering wheel is acted upon by the second operator for maintaining the sight 10 on the marking line trace at L—L, the applicator device D will also be maintained on such line trace and will therefore provided to lay down the tape material S exactly thereon and correctly locate the resulting traffic regulating indicium M, irrespectively of the actual position of the motor-van V, of course within the limits of the admissible (by the structure limitations) lateral displacement of the device D relatively to the motor-van V.

The manner in which the new arrangement operates can be termed as a two-step sequential arrangement. As a matter of fact, the first operator, who drives the motor-van has simply to drive the van acting on the conventional autocar controls, maintaining a good but not extreme precision of driving. The second operator, who acts on the auxiliary steering wheel Ga, has his attention focused upon the sight 10 and the trace of the marking line L—L only can promptly and readily provide to make the necessary adjustments for "correcting" the approximate path of the motor-van to a precise path to be actually followed by the applicator device D.

As clearly shown in FIG. 1, this first embodiment of the invention comprises a tape material applicator assembly (the sight 10 and its collimator stem 12 are properly parts of such assembly as contributing to the positioning of the indicia) located laterally of the motor-van. This arrangement is not completely favourable from the point of view the driving of the motor-van in a rather good approximated path relatively to the marking line. The second operator is also seated within the motor-van and can comfortably act on the auxiliary steering wheel Ga and the other controls of the applicator device, but he has not the marking line trace just in front of him. An arrangement as shown in FIG. 1 is not therefore completely convenient for marking on mountain roads and curved suburban streets, while it is most adapted and preferred for long continuous work along generally straight highways and speedways, wherein either of the operators can comfortably operate and generally slight and progressive adjustments are to be made. The lateral arrangement of the tape applicator subassembly is also advantageous when traffic lanes dividing lines are to be marked where at least two-lanes are provided for one-direction traffic. The apparatus can travel on one lane, leaving the adjacent one unobstructed for the traffic.

Figure 2:
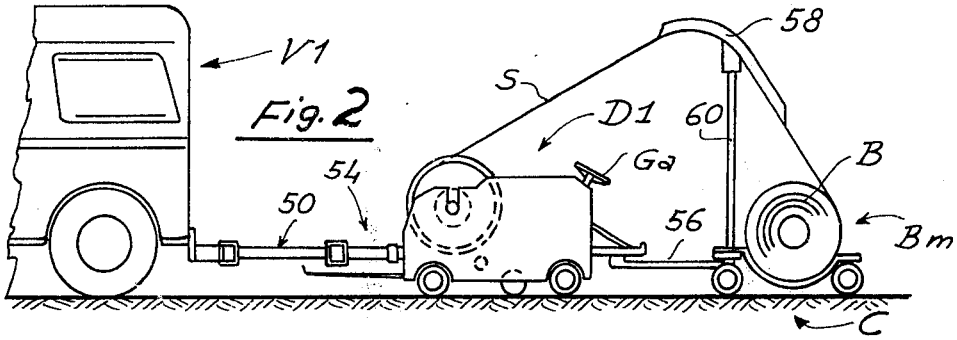
FIGS. 2 and 3 are fragmentary diagrammatical side elevational and respectively plan views of a second embodiment of the invention.
Figure 3:
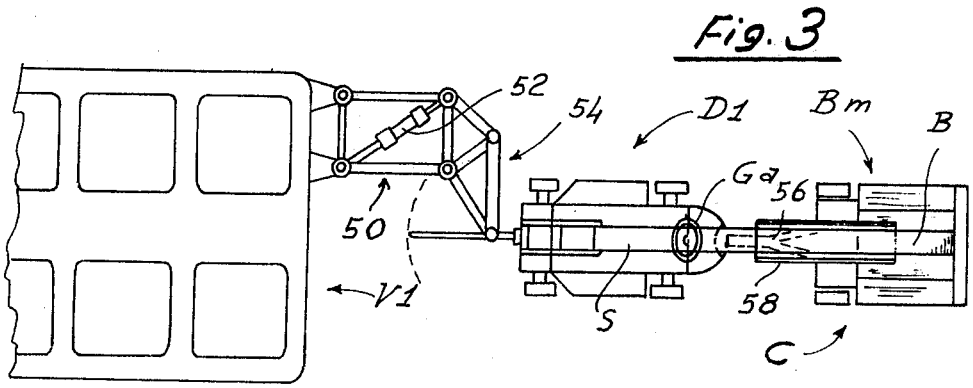

A less specialized but very versatile apparatus embodying the principles of the invention is shown in FIGS. 2 and 3. This embodiment comprises a motor-van V1 trailing a tape applicator subassembly which, if required, can be individually operated, such as where the entire apparatus cannot be steered into intricate and/or very small radius curved patterns, for making of road crossings, parking areas and so on. The subassembly comprises a tape material applicator device D1 the frame structure of which consists of a small three- or four-wheeled vehicle having steering means and an auxiliary steering wheel Ga on which the second operator can act while standing for example on a platform secured to the rear portion of said frame structure. The same device D1 is provided with a marking line trace collimator system including a sight and a collimation stem, as above described.

For regular operation, the device D1 is towed by the motor-van V1 by means of a coupling including a deformable structure generally indicated at 50 and provided with actuator means, such as a two-stroke fluid actuator 52 for laterally displacement, at command, a brace structure 54 to which the device D1 is detachably coupled. A follow-up hydraulic link interconnects the said actuator 52, the steering mechanism of the device and the auxiliary steering wheel Ga on said device to provide the desired lateral adjustments of the position of the device relatively to the towing motor-van, upon constant collimation of the sight on the marking line trace (not shown in FIG. 3) at second operator's command, as above described.

The motor-van V1 usually carries a proper storage of tape material bobbins, and the applicator device can be supplied with said tape material from said motor-van. On the other part, and in view of the fact that a rather extensive work may be expected for the individually operated applicator assembly, a small truck or cart C is preferably associated to and towed by the device D1 by means of a tow-bar 56. This truck C carries the bobbin B which supplies the applicator device D1, in operation, by means of a guide 58 supported by a post 60, and preferably a small magazine or storage Bm of spare bobbins, so that the subassembly can perform a satisfyingly extended work while individually operating, without the assistance of its "parent" service unit.

Of course, a fastly performed road marking, such as at a speed of 5 kilometers/hour or more, require the cooperation of the service unit, that is of the motor-van V1, which can supply the relevant amounts of tape material, of the compounds necessary for forming the primer layer, the fuel (such as liquified gas) for powerful burners and so on. The individual operation of the subassembly is noticeably slower, such as at two kilometers/hour or less, and the tape material is laid down on the bare road or parking area pavement, or over a preliminarily prepared primer layer. On the other part, the availability of means capable of performing this individual operation is generally desirable, in particularly for providing the intricate marking pattern of parking areas and in similar occurrences. The individually operating applicator assembly can be displaced by hand, at such low speeds, along the marking line trace (no problems about precise steering exist in such occurrence) or the device D1 can be provided with a small gasoline motor, or also with an electric motor supplied, by means of a conventional flexible conductor or cable, by any available source of current, such as the same service unit which can be parked at a not too far location.

In the regular operation of an apparatus such as that shown in FIG. 1 or that shown in FIGS. 2 and 3, the driver of the motor-van (that is the first operator) is responsible for the general driving of the apparatus, he looks well far ahead for obstacles and for a general consideration of the travel of same apparatus. The second operator, acting with the auxiliary steering sheel Ga, is responsible for the exact laying down of the tape material over the marking line trace. This latter operator, therefore, focuses his attention at a very brief distance ahead of the sight 10 (FIG. 1) or other collimating means with which the applicator subassembly is provided.

In certain occurrences, such as when curving mountain roads are to be marked, the second operator requires the most ample and complete visibility, while a somewhat slower speed of travel is accepted for the sake of a proper marking. Either one of the embodiments of FIGS. 4 to 7 is particularly adapted for operating in such occurrences.

In FIGS. 4 and 5, the service unit forming motor-van V2 pushes an applicator device D2 located ahead of said motor-van. This device D2 can be similar to that of FIGS. 2 and 3 and it is provided with steering wheels, a steering means Ga, a sight 66 and a collimator stem 68 and it is connected to the pushing motor-van V2 by means of essentially flexible pushing rods 62 and 64, so that said motor-van V2 can follow the path of the applicator device with a somewhat approximation within a reasonable amplitude of relative lateral displacement. The tape material S is supplied by the motor-van such as through a guide channel 70 broadly equivalent to the guide support 58 of FIGS. 2 and 3. The applicator device D2 can be detached from the service unit for individual operation, and connected to a tape supplying truck such that indicated at C in same FIGS. 2 and 3, if required.

The embodiment of FIG. 6 illustrates a modified means for having the applicator device D3 promptly detachable from the service motor-van V3. Said motor-van has a forwardly extended member 70 which carries a pusher roller 72 freely rotatable about a vertical axis, and the frame structure of the applicator device D3 has a laterally extended bumper 74 on which said roller 72 abuts for exerting the desired pushing action. Of course this arrangement can be reversed, and the device D3 can carry a rear roller or other suitable means for laterally displaceable abutment of a forwardly facing bumper secured to the front of the motor-van.

The applicator device D3 can be supplied with the tape material S from the motor-van, which can be provided with tape bobbin and storage means and with tape sliding support and guide means such as shown in FIGS. 4 and 5, or from a truck C3, corresponding to that of FIGS. 2 and 3, the tape being guidedly passed above the motor-van. For independent use, the conventional tow-bar of truck C3 can be detached from the motor-van and coupled at the rear part of the applicator device.

As before explained with reference to FIG. 1, a lateral arrangement of the tape applicator subassembly, relatively to the service unit, provides certain advantages. The arrangement of FIG. 7 combines the features of that of FIG. 1 and of that of FIG. 6. The applicator device D3 of FIG. 6 is associated to a motor-van V4 generally of the type of FIG. 1 and pushed thereby by means of a roller 72 supported by a brace 80 connected to the motor-van frame by means of a folding structure 82 the lateral projection of which can be adjusted by means of a suitable actuator 84.

I claim:

1. An apparatus for applying tape material along a predetermined path defined by a marking line as outlined by a predetermined marking trace, in combination, comprising a service unit comprising a motor-van and a subassembly including a tape applicator device, said tape applicator device being located ahead of said service unit, said service unit having first steering means adapted to be operated by a first operator for driving said unit at a given speed along a first path approximately concurrent with said marking line, said subassembly having second steering means adapted to be operated by a second operator; sight and collimating means operative for collimation with said predetermined marking trace, said second steering means and said sight and collimating means being interconnected to provide the positioning of said tape applicator device upon said marking line as said sight and collimating means are collimated with said predetermined marking trace; and means for permitting relative lateral displacement between said service unit and said interconnected subassembly so as to compensate for differences between the path actually followed by said service unit and that of said tape applicator device upon and along said marking trace, said means for permitting relative lateral movement including pushing means for pushing said tape applicator device ahead of said service unit.

2. The apparatus defined in claim 1, wherein said pushing means comprises a roller supported for idle rotation about a vertical axis and a transversely extending bumper abutting against said roller.

3. The apparatus as defined in claim 1, wherein said pushing means comprises a spaced pair of flexible pushing rods intermediate with and connected to said service unit and said device, the flexibility of said rods cooperating with said second steering means of permitting lateral displacement of said device relative to said unit.

4. The apparatus as defined in claim 3, wherein in said rods are disposed at opposite lateral sides of said unit and said device, respectively.

5. The apparatus as defined in claim 1; and further comprising tape-supplying means on said service unit, and guide means for guiding said tape from said service unit to said tape applicator device.

6. An apparatus for applying tape material along a predetermined path defined by a marking line as outlined by a predetermined marking trace, in combination, comprising a service unit comprising a motor-van and a subassembly including a tape applicator device, said tape applicator device being located ahead of said service unit, said service unit having first steering means adapted to be operated by a first operator for driving said unit at a given speed along a first path approximately concurrent with said marking line, said subassembly having second steering means adapted to be operated by a second operator; sight and collimating means operative for collimation with said predetermined marking trace, said second steering means and said sight and collimating means being interconnected to provide the positioning of said tape applicator device upon said marking line as said sight and collimating means are collimated with said predetermined marking trace; means for permitting relative lateral displacement between said service unit and said interconnected subassembly so as to compensate for differences between the path actually followed by said service unit and that of said tape applicator device upon and along said marking trace; and tape supplying means on said service unit, and guide means for guiding said tape from said service unit to said tape applicator device.

7. The apparatus as defined in claim 6, said guide means comprising a guide channel disposed upwardly of said service unit.

* * * * *